US008931925B2

(12) United States Patent
Yang

(10) Patent No.: US 8,931,925 B2
(45) Date of Patent: Jan. 13, 2015

(54) LED HEAT DISSIPATION DEVICE HAVING AXIAL AND RADIAL CONVECTION HOLES

(76) Inventor: Tai-Her Yang, Dzan-Hwa (TW)

( * ) Notice: Subject to any disclaimer, the term of this patent is extended or adjusted under 35 U.S.C. 154(b) by 222 days.

(21) Appl. No.: 13/345,848

(22) Filed: Jan. 9, 2012

(65) Prior Publication Data

US 2013/0176726 A1 Jul. 11, 2013

(51) Int. Cl.
*F21V 29/00* (2006.01)

(52) U.S. Cl.
USPC ..... 362/294; 362/373

(58) Field of Classification Search
CPC ..... F21V 29/00; F21V 29/2293; F21V 29/02; F21V 29/004
USPC ..... 362/373, 294
See application file for complete search history.

(56) References Cited

U.S. PATENT DOCUMENTS

| | | | | |
|---|---|---|---|---|
| 7,144,140 | B2 * | 12/2006 | Sun et al. | 362/373 |
| 7,832,909 | B2 * | 11/2010 | Wang | 362/364 |
| 7,841,752 | B2 * | 11/2010 | Lee | 362/373 |
| 2010/0060130 | A1 * | 3/2010 | Li | 313/46 |
| 2010/0187963 | A1 | 7/2010 | Vaccaro | |
| 2010/0214781 | A1 * | 8/2010 | Chiu et al. | 362/249.06 |
| 2010/0237782 | A1 * | 9/2010 | Horng et al. | 315/117 |
| 2010/0264800 | A1 | 10/2010 | Liu et al. | |
| 2011/0193463 | A1 | 8/2011 | Daniel | |
| 2011/0309751 | A1 | 12/2011 | Ter-Hovhannisyan | |

FOREIGN PATENT DOCUMENTS

| | | | |
|---|---|---|---|
| EP | 2287527 | A1 | 2/2011 |
| WO | WO/2010027923 | A1 | 3/2010 |
| WO | WO/2011112005 | A2 | 9/2011 |
| WO | WO/2012000225 | A1 | 1/2012 |

* cited by examiner

*Primary Examiner* — Julie Bannan
(74) *Attorney, Agent, or Firm* — Bacon & Thomas, PLLC

(57) ABSTRACT

The present invention provides a LED heat dissipation device having axial and radial convection holes for meeting the heat dissipation requirement of a light emitting diode (LED), so the heat dissipation device is not only equipped with a function of dissipating heat to the exterior through the surface of the heat dissipation device, but also provided with the air flowing capable of assisting heat dissipation through the hot airflow in a heat dissipation member having axial and radial convection holes (101) generating a hot ascent/cold descent effect for introducing airflow from an air inlet port formed near a light projection side to pass an axial tubular flowpath (102) then be discharged from a radial air outlet hole (107) formed near a connection side (104) of the heat dissipation member having axial and radial convection holes (101).

12 Claims, 12 Drawing Sheets

LED HEAT DISSIPATION DEVICE HAVING AXIAL AND RADIAL CONVECTION HOLES

BACKGROUND OF THE INVENTION (a) Field of the Invention

The present invention provides a LED heat dissipation device having axial and radial convection holes for meeting the heat dissipation requirement of a light emitting diode (LED), so the heat dissipation device is not only equipped with a function of dissipating heat to the exterior through the surface of the heat dissipation device, but also provided with the air flowing capable of assisting heat dissipation through the hot airflow in a heat dissipation member having axial and radial convection holes (101) generating a hot ascent/cold descent effect for introducing airflow from an air inlet port formed near a light projection side to pass an axial tubular flowpath (102) then be discharged from a radial air outlet hole (107) formed near a connection side (104) of the heat dissipation member having axial and radial convection holes (101).

(b) Description of the Prior Art

A conventional LED heat dissipation device generally transmits the thermal energy of LED to the heat dissipation device for discharging heat to the exterior through the surface of the heat dissipation device, and said conventional LED heat dissipation device is not provided with an inner heat dissipation surface formed by axial holes for utilizing the airflow from an air inlet port passing the inner heat dissipation surface formed by the axial holes for discharging heat to the exterior through a radial air outlet hole. The present invention is provided with an axial hole formed on an axial tubular flowpath (102) fabricated in a heat dissipation member having axial and radial convection holes (101), so the airflow from an air inlet part can be used for discharging the hot airflow in the axial hole to the exterior through a radial air outlet hole; therefore beside the surface of the heat dissipation device used for dissipating heat to the exterior, the present invention is provided with the air flowing capable of assisting heat dissipation through the hot airflow in a heat dissipation member having axial and radial convection holes (101) generating a hot ascent/cold descent effect for introducing airflow from an air inlet port formed near a light projection side to pass an axial tubular flowpath (102) then be discharged from a radial air outlet hole (107) formed near a connection side (104) of the heat dissipation member having axial and radial convection holes (101).

SUMMARY OF THE INVENTION

A conventional LED heat dissipation device generally transmits the thermal energy of LED to the heat dissipation device for discharging heat to the exterior through the surface of the heat dissipation device, and said conventional LED heat dissipation device is not provided with an inner heat dissipation surface formed by axial holes for utilizing the airflow from an air inlet port passing the inner heat dissipation surface formed by the axial holes for discharging heat to the exterior through a radial air outlet hole. The present invention provides a LED heat dissipation device having axial and radial convection holes for meeting the heat dissipation requirement of a light emitting diode (LED), an axial hole is formed on an axial tubular flowpath (102) fabricated in a heat dissipation member having axial and radial convection holes (101), so the airflow from an air inlet part can be used for discharging the hot airflow in the axial hole to the exterior through a radial air outlet hole; therefore beside the surface of the heat dissipation device used for dissipating heat to the exterior, the present invention is provided with the air flowing capable of assisting heat dissipation through the hot airflow in a heat dissipation member having axial and radial convection holes (101) generating a hot ascent/cold descent effect for introducing airflow from an air inlet port formed near a light projection side to pass an axial tubular flowpath (102) then be discharged from a radial air outlet hole (107) formed near a connection side (104) of the heat dissipation member having axial and radial convection holes (101).

Figure 1:
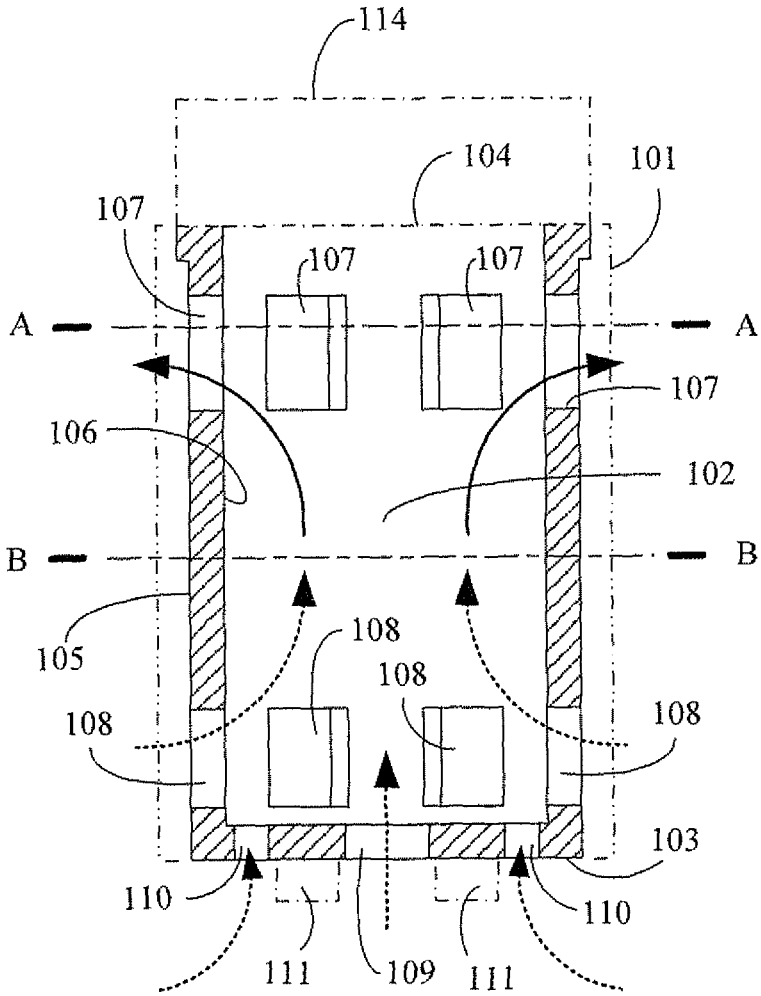
FIG. 1 is a schematic view showing the basic structure and operation of the present invention.

DESCRIPTION OF MAIN COMPONENT SYMBOLS (101) Heat dissipation member having axial and radial convection holes
(102): Axial tubular flowpath
(103): Light projection side
(104): Connection side
(105): External heat dissipation surface
(106): Internal heat dissipation surface
(107): Radial air outlet hole
(108): Radial air inlet port
(109): Central axial air inlet port
(110): Air inlet port annularly arranged near the periphery of axial end surface
(111): Light emitting diode
(112): Secondary optical device
(113): Light-pervious lampshade
(114): Axially-fixed and electric-conductive interface
(115): Radially-fixed and electric-conductive interface
(116): Top cover member
(200): Heat dissipation fin structure
(300): Electric motor driven fan

DETAILED DESCRIPTION OF THE PREFERRED EMBODIMENTS

A conventional LED heat dissipation device generally transmits the thermal energy of LED to the heat dissipation device for discharging heat to the exterior through the surface of the heat dissipation device, and said conventional LED heat dissipation device is not provided with an inner heat dissipation surface formed by axial holes for utilizing the airflow from an air inlet port passing the inner heat dissipation surface formed by the axial holes for discharging heat to the exterior through a radial air outlet hole. The present invention is provided with an axial hole formed on an axial tubular flowpath (102) fabricated in a heat dissipation member having axial and radial convection holes (101), so the airflow from an air inlet part can be used for discharging the hot airflow in the axial hole to the exterior through a radial air outlet hole; therefore beside the surface of the heat dissipation device used for dissipating heat to the exterior, the present invention is provided with the air flowing capable of assisting heat dissipation through the hot airflow in a heat dissipation member having axial and radial convection holes (101) generating a hot ascent/cold descent effect for introducing airflow from an air inlet port formed near a light projection side to pass an axial tubular flowpath (102) then be discharged from a radial air outlet hole (107) formed near a connection side (104) of the heat dissipation member having axial and radial convection holes (101).

The present invention provides a LED heat dissipation device having axial and radial convection holes for meeting the heat dissipation requirement of a light emitting diode (LED), so the heat dissipation device is not only equipped with a function of dissipating heat to the exterior through the surface of the heat dissipation device, but also provided with the air flowing capable of assisting heat dissipation through the hot airflow in a heat dissipation member having axial and radial convection holes (101) generating a hot ascent/cold descent effect for introducing airflow from an air inlet port formed near a light projection side to pass an axial tubular flowpath (102) then be discharged from a radial air outlet hole (107) formed near a connection side (104) of the heat dissipation member having axial and radial convection holes (101).

Figure 2:
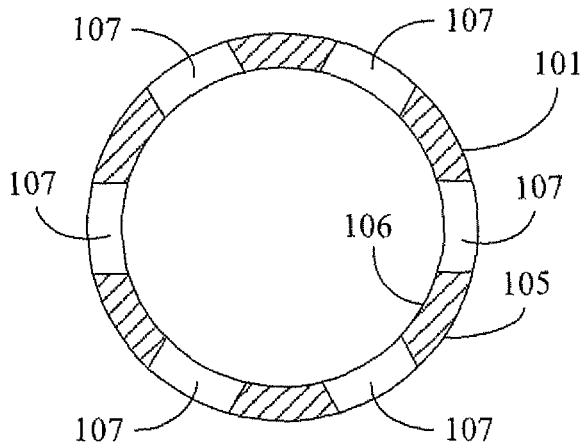
FIG. 2 is a cross sectional view of FIG. 1 taken from A-A cross section.

FIG. 1 is a schematic view showing the basic structure and operation of the present invention;

FIG. 2 is a cross sectional view of FIG. 1 taken from A-A cross section;

As shown in FIG. 1 and FIG. 2, it mainly consists of:

heat dissipation member having axial and radial convection holes (101): made of a material having good heat conductivity and formed as an integral or assembled hollow member, and said hollow member is a sealed or semi-sealed structure, the outer radial surface is formed as a smooth surface, rib surface, grid surface, porous, net-shaped or fin-shaped structure, thereby forming an external heat dissipation surface (105); the radial interior is formed as a smooth surface, rib surface, grid surface, porous, net-shaped or fin-shaped structure, thereby forming an internal heat dissipation surface (106); the center is formed with an axial tubular flowpath (102) serving as an axial hole allowing airflow to pass, and one axial side of the heat dissipation member having axial and radial convection holes (101) is defined as a light projection side (103) allowing a LED (111) to be installed thereon, and the other axial side is defined as a connection side (104) serving as the structure for external connection;

one end of the heat dissipation member having axial and radial convection holes (101) near the connection side (104) is installed with one or more than one radial air outlet holes (107), and the light projection side (103) is installed with one or more than one air inlet ports, said air inlet ports are installed to at least one or more than one of three locations which include the outer periphery being installed with a radial air inlet port (108) and/or the center of axial end surface of the light projection side (103) being installed with a central axial air inlet port (109) and/or the light projection side (103) being installed with an air inlet port annularly arranged near the periphery of axial end surface (110);

With the mentioned structure when generating heat loss during the LED (111) being electrically conducted for emitting light, the air flowing formed through the hot airflow in the heat dissipation member having axial and radial convection holes (101) generating a hot ascent/cold descent effect for introducing airflow from the air inlet port formed near the light projection side to pass the axial hole configured by the axial tubular flowpath (102) then be discharged from the radial air outlet hole (107) formed near the connection side (104) of the heat dissipation member having axial and radial convection holes (101), thereby discharging thermal energy in the axial tubular flowpath (102) to the exterior.

Figure 3:
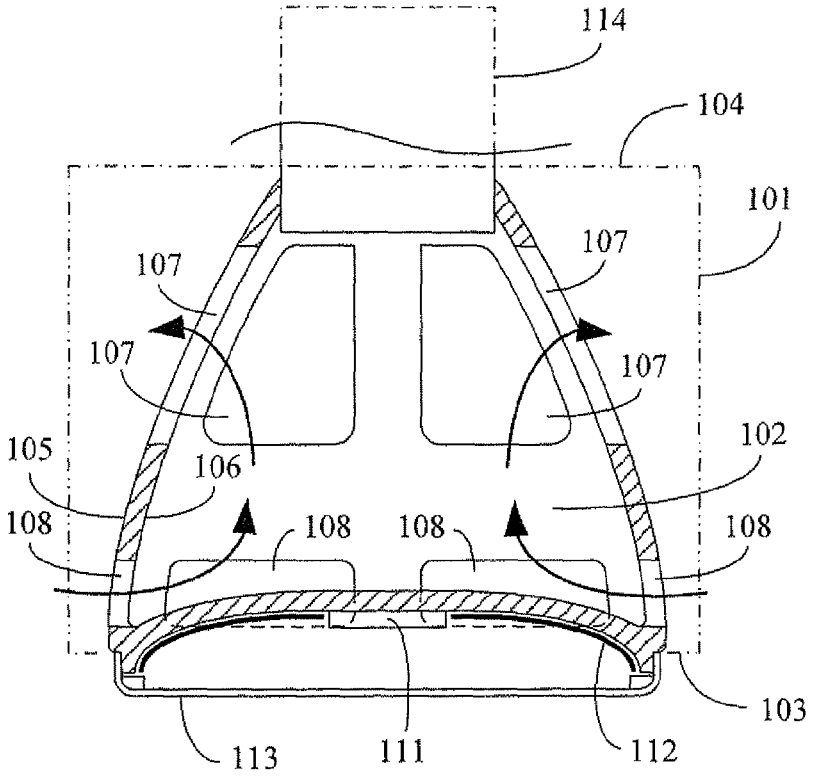
FIG. 3 is a schematic structural view illustrating an electric-powered light emitting unit being installed at the center of the end surface of a light projection side and a radial air inlet port (108) being formed near the outer periphery of the light projection side, according to one embodiment of the present invention.
Figure 4:
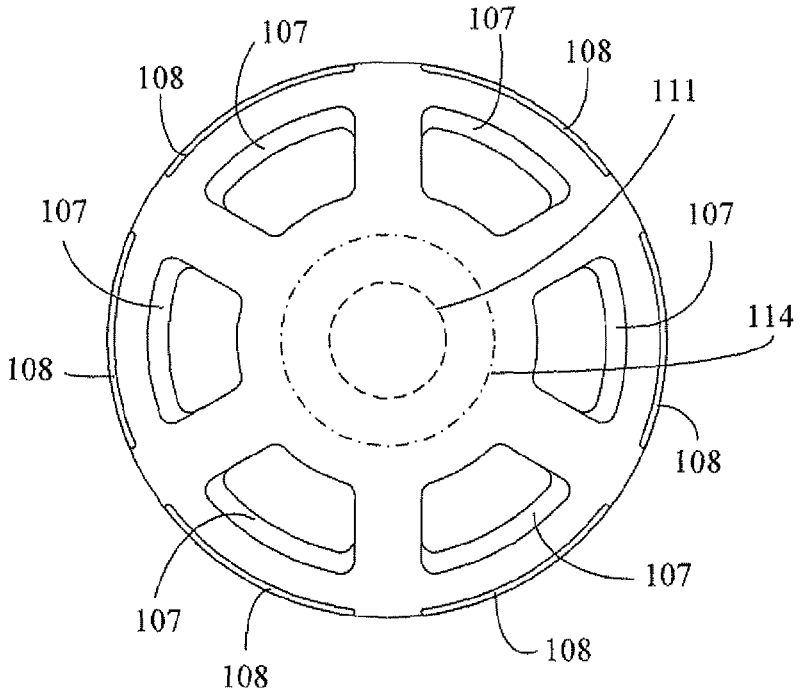
FIG. 4 is a top view of FIG. 3.

FIG. 3 is a schematic structural view illustrating an electric-powered light emitting unit being installed at the center of the end surface of a light projection side and a radial air inlet port (108) being formed near the outer periphery of the light projection side, according to one embodiment of the present invention;

FIG. 4 is a top view of FIG. 3;

As shown in FIG. 3 and FIG. 4, it mainly consists of:

heat dissipation member having axial and radial convection holes (101): made of a material having good heat conductivity and formed as an integral or assembled hollow member, and said hollow member is a sealed or semi-sealed structure, the outer radial surface is formed as a smooth surface, rib surface, grid surface, porous, net-shaped or fin-shaped structure, thereby forming an external heat dissipation surface (105); the radial interior is formed as a smooth surface, rib surface, grid surface, porous, net-shaped or fin-shaped structure, thereby forming an internal heat dissipation surface (106); the center is formed with an axial tubular flowpath (102) serving as an axial hole allowing airflow to pass, and one axial side of the heat dissipation member having axial and radial convection holes (101) is defined as a light projection side (103) allowing a LED (111) to be installed thereon, and the other axial side is defined as a connection side (104) serving as the structure for external connection;

one end of the heat dissipation member having axial and radial convection holes (101) near the connection side (104) is installed with one or more than one radial air outlet holes (107), and said radial air outlet hole (107) includes grid holes configured by a hole-shaped or net-shaped structure;

With the mentioned structure when generating heat loss during the LED (111) being electrically conducted for emitting light, the air flowing formed through the hot airflow in the heat dissipation member having axial and radial convection holes (101) generating a hot ascent/cold descent effect for introducing airflow from one or more than one radial air inlet ports (108) of the light projection side (103) to pass the axial hole configured by the axial tubular flowpath (102) then be discharged from the radial air outlet hole (107) formed near the connection side (104) of the heat dissipation member having axial and radial convection holes (101), thereby discharging thermal energy in the axial tubular flowpath (102) to the exterior;

light emitting diode (LED) (111): constituted by one or more than one light emitting diodes or modules, and installed at the center of the light projection side (103) of the heat dissipation member having axial and radial convection holes (101);

radial air inlet port (108): constituted by one or more than one radial air inlet ports (108) installed near the outer periphery of the light projection side (103) of the heat dissipation member having axial and radial convection holes (101), and said radial air inlet port (108) includes grid holes configured by a hole-shaped or net-shaped structure;

secondary optical device (112): provided with functions of condensing, diffusing, refracting or reflecting the optical energy of the LED (111) for projecting light to the exterior;

light-pervious lampshade (113): made of a light-pervious material, covering the LED (111) for the purpose of protecting the LED (111), and allowing the optical energy of LED (111) passing through for projecting to the exterior;

axially-fixed and electric-conductive interface (114): one end thereof is connected to the connection side (104) of the heat dissipation member having axial and radial convection holes (101), the other end is a screw-in type, insertion type or lock-on type lamp head or lamp holder structure, or an electric conductive interface structure configured by an electric conductive terminal structure, provided as a connection interface for the LED (111) and an axial external electric power, and connected to the LED (111) with an electric conductive member for transmitting electric power.

Figure 5:
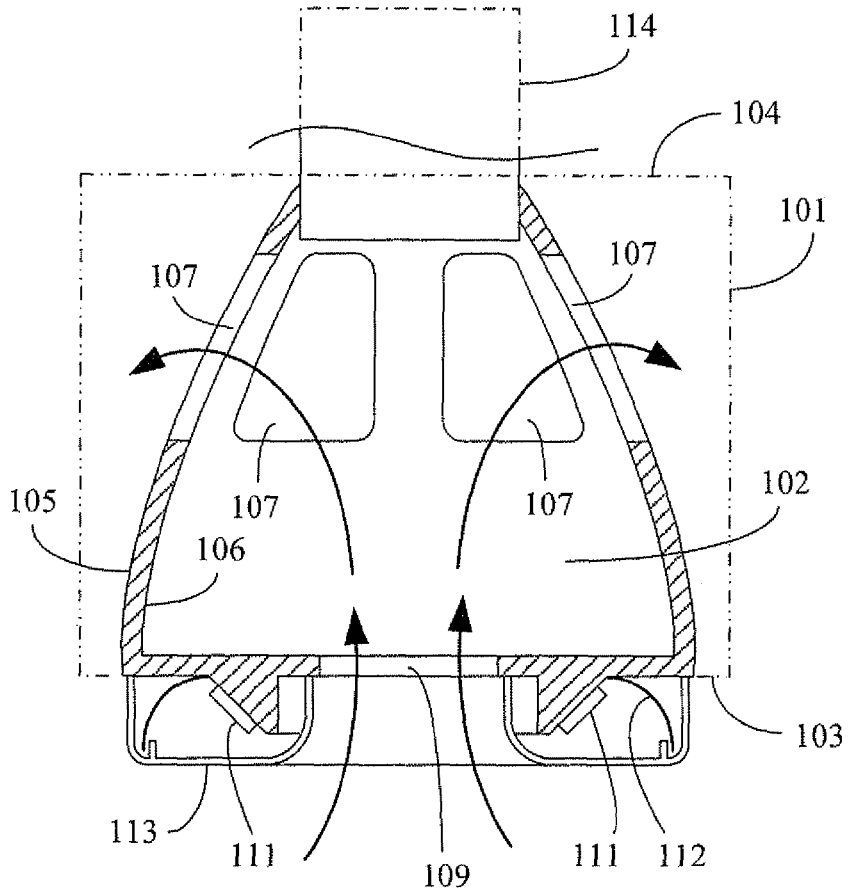
FIG. 5 is a schematic structural view illustrating the electric-powered light emitting unit being annularly installed near the outer periphery of the light projection side and the center being formed with a central axial air inlet port (109), according to one embodiment of the present invention.
Figure 6:
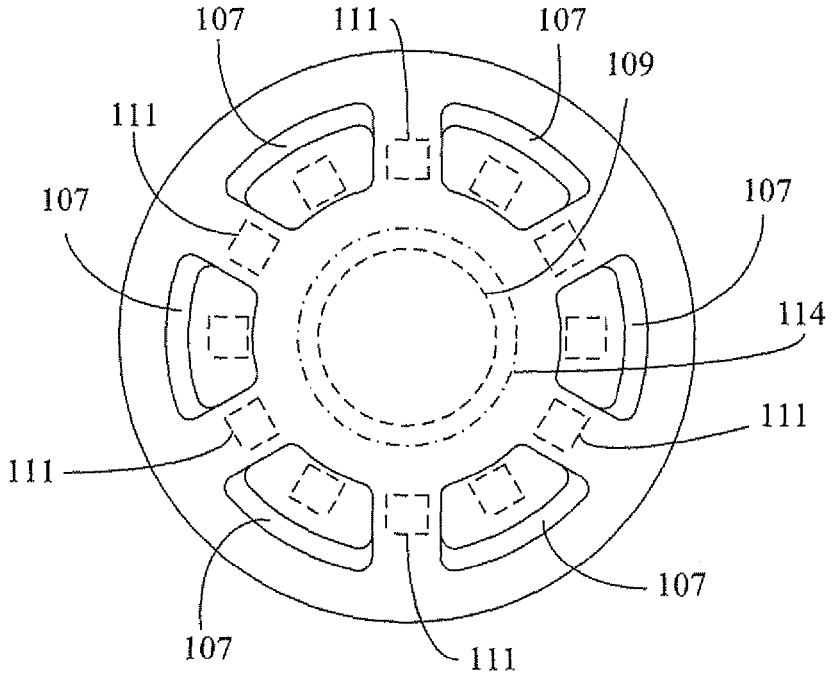
FIG. 6 is a top view of FIG. 5.

FIG. 5 is a schematic structural view illustrating the electric-powered light emitting unit being annularly installed near the outer periphery of the light projection side and the center being formed with a central axial air inlet port (109), according to one embodiment of the present invention;

FIG. 6 is a top view of FIG. 5;

As shown in FIG. 5 and FIG. 6, it mainly consists of:

heat dissipation member having axial and radial convection holes (101): made of a material having good heat conductivity and formed as an integral or assembled hollow member, and said hollow member is a sealed or semi-sealed structure, the outer radial surface is formed as a smooth surface, rib surface, grid surface, porous, net-shaped or fin-shaped structure, thereby forming an external heat dissipation surface (105); the radial interior is formed as a smooth surface, rib surface, grid surface, porous, net-shaped or fin-shaped structure, thereby forming an internal heat dissipation surface (106); the center is formed with an axial tubular flowpath (102) serving as an axial hole allowing airflow to pass, and one axial side of the heat dissipation member having axial and radial convection holes (101) is defined as a light projection side (103) allowing a LED (111) to be installed thereon, and the other axial side is defined as a connection side (104) serving as the structure for external connection;

one end of the heat dissipation member having axial and radial convection holes (101) near the connection side (104) is installed with one or more than one radial air outlet holes (107), and said radial air outlet hole (107) includes grid holes configured by a hole-shaped or net-shaped structure;

With the mentioned structure when generating heat loss during the LED (111) being electrically conducted for emitting light, the air flowing formed through the hot airflow in the heat dissipation member having axial and radial convection holes (101) generating a hot ascent/cold descent effect for introducing airflow from the central axial air inlet port (109) of the light projection side (103) to pass the axial hole configured by the axial tubular flowpath (102) then be discharged from the radial air outlet hole (107) formed near the connection side (104) of the heat dissipation member having axial and radial convection holes (101), thereby discharging thermal energy in the axial tubular flowpath (102) to the exterior;

light emitting diode (LED) (111): constituted by one or more than one light emitting diodes or modules, and installed at the outer periphery of the light projection side (103) of the heat dissipation member having axial and radial convection holes (101);

central axial air inlet port (109): constituted by a central axial air inlet port structure installed on the axial end surface of the light projection side (103) of the heat dissipation member having axial and radial convection holes (101) for communicating to the axial tubular flowpath (102), and said central axial air inlet port (109) includes grid holes configured by a hole-shaped or net-shaped structure;

secondary optical device (112): provided with functions of condensing, diffusing, refracting or reflecting the optical energy of the LED (111) for projecting light to the exterior;

light-pervious lampshade (113): made of a light-pervious material, covering the LED (111) for the purpose of protecting the LED (111), and allowing the optical energy of LED (111) passing through for projecting to the exterior;

axially-fixed and electric-conductive interface (114): one end thereof is connected to the connection side (104) of the heat dissipation member having axial and radial convection holes (101), the other end is a screw-in type, insertion type or lock-on type lamp head or lamp holder structure, or an electric conductive interface structure configured by an electric conductive terminal structure, provided as a connection interface for the LED (111) and an axial external electric power, and connected to the LED (111) with an electric conductive member for transmitting electric power.

Figure 7:
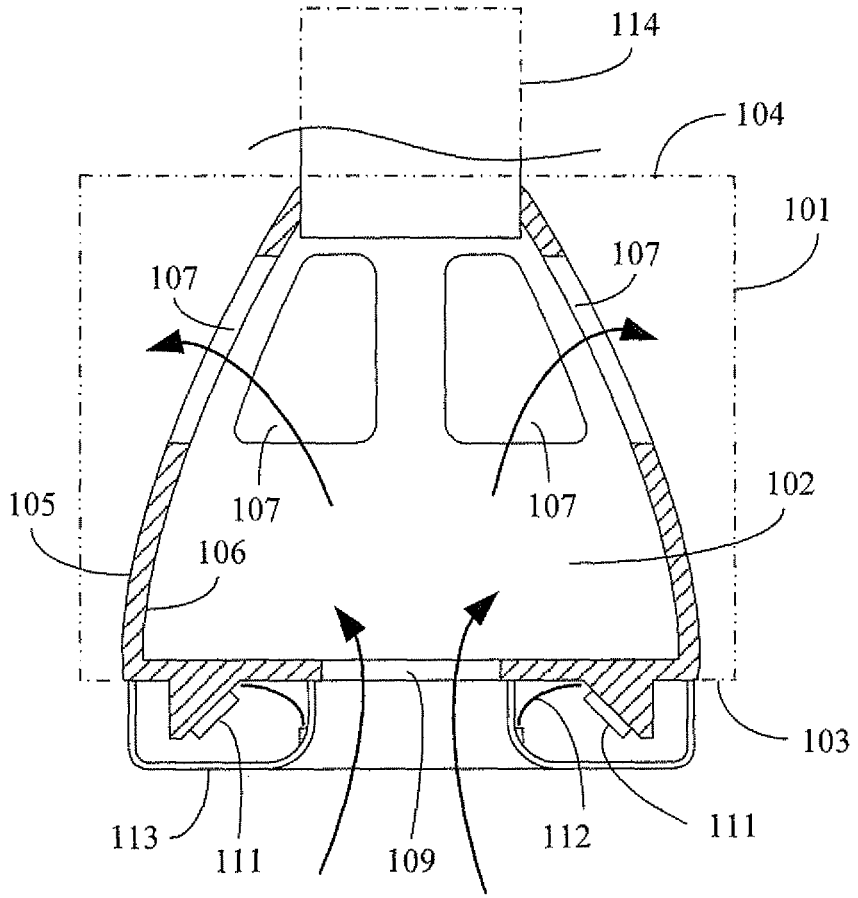
FIG. 7 is a schematic structural view illustrating the electric-powered light emitting unit being annularly installed near the inner periphery of the light projection side and the center being formed with a central axial air inlet port (109), according to one embodiment of the present invention.
Figure 8:
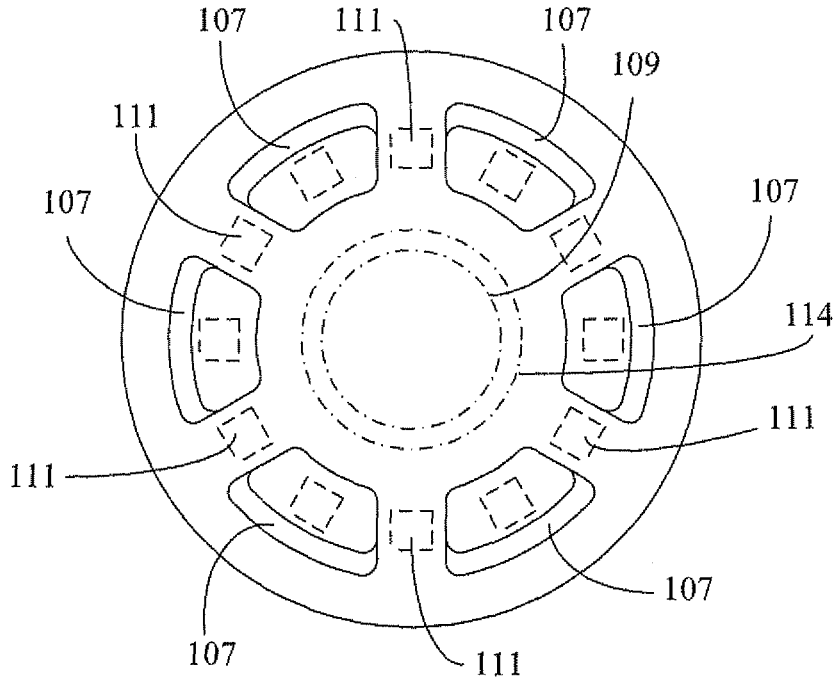
FIG. 8 is a top view of FIG. 7.

FIG. 7 is a schematic structural view illustrating the electric-powered light emitting unit being annularly installed near the inner periphery of the light projection side and the center being formed with a central axial air inlet port (109), according to one embodiment of the present invention;

FIG. 8 is a top view of FIG. 7;

As shown in FIG. 7 and FIG. 8, it mainly consists of:

heat dissipation member having axial and radial convection holes (101): made of a material having good heat conductivity and formed as an integral or assembled hollow member, and said hollow member is a sealed or semi-sealed structure, the outer radial surface is formed as a smooth surface, rib surface, grid surface, porous, net-shaped or fin-shaped structure, thereby forming an external heat dissipation surface (105); the radial interior is formed as a smooth surface, rib surface, grid surface, porous, net-shaped or fin-shaped structure, thereby forming an internal heat dissipation surface (106); the center is formed with an axial tubular flowpath (102) serving as an axial hole allowing airflow to pass, and one axial side of the heat dissipation member having axial and radial convection holes (101) is defined as a light projection side (103) allowing a LED (111) to be installed thereon, and the other axial side is defined as a connection side (104) serving as the structure for external connection;

one end of the heat dissipation member having axial and radial convection holes (101) near the connection side (104) is installed with one or more than one radial air outlet holes (107), and said radial air outlet hole (107) includes grid holes configured by a hole-shaped or net-shaped structure;

With the mentioned structure when generating heat loss during the LED (111) being electrically conducted for emitting light, the air flowing formed through the hot airflow in the heat dissipation member having axial and radial convection holes (101) generating a hot ascent/cold descent effect for introducing airflow from the central axial air inlet port (109) of the light projection side (103) to pass the axial hole configured by the axial tubular flowpath (102) then be discharged from the radial air outlet hole (107) formed near the connection side (104) of the heat dissipation member having axial and radial convection holes (101), thereby discharging thermal energy in the axial tubular flowpath (102) to the exterior;

light emitting diode (LED) (111): constituted by one or more than one light emitting diodes or modules, and installed at the inner periphery of the light projection side (103) of the heat dissipation member having axial and radial convection holes (101);

central axial air inlet port (109): constituted by a central axial air inlet port structure installed on the axial end surface of the light projection side (103) of the heat dissipation member having axial and radial convection holes (101) for communicating to the axial tubular flowpath (102), and said central axial air inlet port (109) includes grid holes configured by a hole-shaped or net-shaped structure;

secondary optical device (112): provided with functions of condensing, diffusing, refracting or reflecting the optical energy of the LED (111) for projecting light to the exterior;

light-pervious lampshade (113): made of a light-pervious material, covering the LED (111) for the purpose of protecting the LED (111), and allowing the optical energy of LED (111) passing through for projecting to the exterior;

axially-fixed and electric-conductive interface (114): one end thereof is connected to the connection side (104) of the heat dissipation member having axial and radial convection holes (101), the other end is a screw-in type, insertion type or lock-on type lamp head or lamp holder structure, or an electric conductive interface structure configured by an electric conductive terminal structure, provided as a connection interface for the LED (111) and an axial external electric power, and connected to the LED (111) with an electric conductive member for transmitting electric power.

Figure 9:
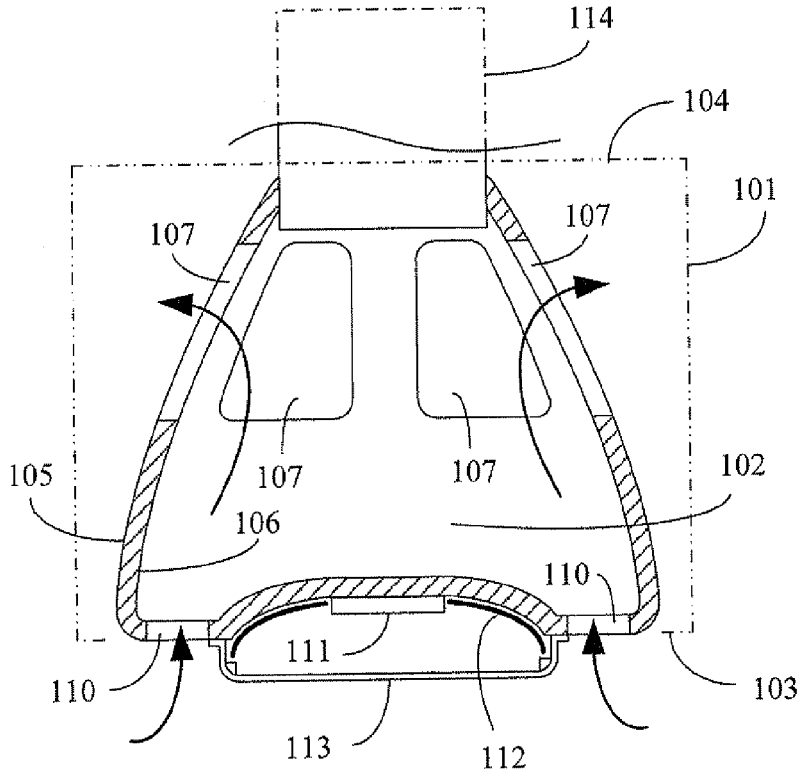
FIG. 9 is a schematic structural view illustrating the electric-powered light emitting unit being installed at the center of the end surface of the light projection side and the light projection side being formed with an air inlet port annularly arranged near the periphery of axial end surface (110), according to one embodiment of the present invention.
Figure 10:
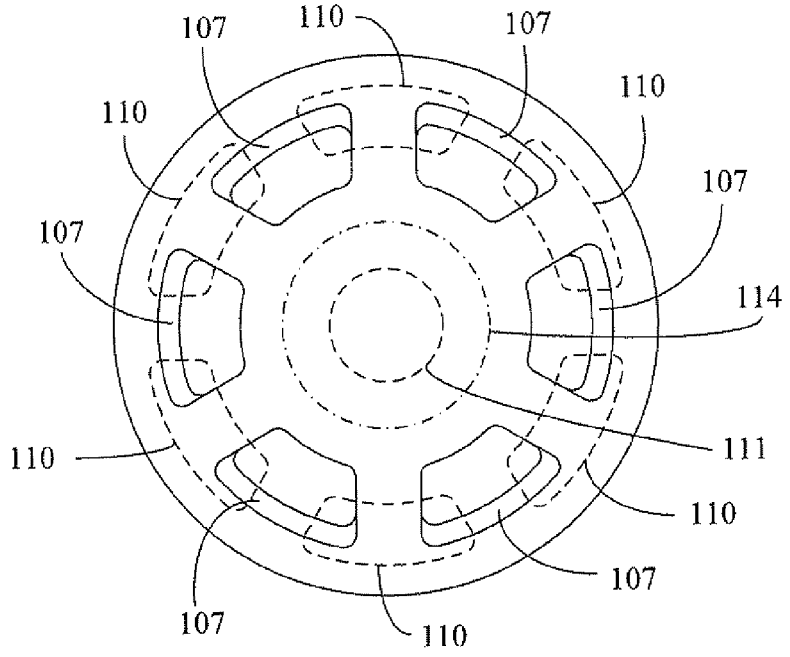
FIG. 10 is a top view of FIG. 9.

FIG. 9 is a schematic structural view illustrating the electric-powered light emitting unit being installed at the center of the end surface of the light projection side and the light projection side being formed with an air inlet port annularly arranged near the periphery of axial end surface (110), according to one embodiment of the present invention;

FIG. 10 is a top view of FIG. 9;

As shown in FIG. 9 and FIG. 10, it mainly consists of:

heat dissipation member having axial and radial convection holes (101): made of a material having good heat conductivity and formed as an integral or assembled hollow member, and said hollow member is a sealed or semi-sealed structure, the outer radial surface is formed as a smooth surface, rib surface, grid surface, porous, net-shaped or fin-shaped structure, thereby forming an external heat dissipation surface (105); the radial interior is formed as a smooth surface, rib surface, grid surface, porous, net-shaped or fin-shaped structure, thereby forming an internal heat dissipation surface (106); the center is formed with an axial tubular flowpath (102) serving as an axial hole allowing airflow to pass, and one axial side of the heat dissipation member having axial and radial convection holes (101) is defined as a light projection side (103) allowing a LED (111) to be installed thereon, and the other axial side is defined as a connection side (104) serving as the structure for external connection;

one end of the heat dissipation member having axial and radial convection holes (101) near the connection side (104) is installed with one or more than one radial air outlet holes (107), and said radial air outlet hole (107) includes grid holes configured by a hole-shaped or net-shaped structure;

With the mentioned structure when generating heat loss during the LED (111) being electrically conducted for emitting light, the air flowing formed through the hot airflow in the heat dissipation member having axial and radial convection holes (101) generating a hot ascent/cold descent effect for introducing airflow from one or more than one air inlet ports annularly arranged near the periphery of axial end surface (110) at the light projection side (103) to pass the axial hole configured by the axial tubular flowpath (102) then be discharged from the radial air outlet hole (107) formed near the connection side (104) of the heat dissipation member having axial and radial convection holes (101), thereby discharging thermal energy in the axial tubular flowpath (102) to the exterior;

light emitting diode (LED) (111): constituted by one or more than one light emitting diodes or modules, and installed at the center of the light projection side (103) of the heat dissipation member having axial and radial convection holes (101);

air inlet port annularly arranged near the periphery of axial end surface (110): constituted by one or more than one air inlet port structures annularly installed near the periphery of axial end surface of the light projection side (103) of the heat dissipation member having axial and radial convection holes (101) for communicating to the axial tubular flowpath (102), and said air inlet port annularly arranged near the periphery of axial end surface (110) includes grid holes configured by a hole-shaped or net-shaped structure;

secondary optical device (112): provided with functions of condensing, diffusing, refracting or reflecting the optical energy of the LED (111) for projecting light to the exterior;

light-pervious lampshade (113): made of a light-pervious material, covering the LED (111) for the purpose of protecting the LED (111), and allowing the optical energy of LED (111) passing through for projecting to the exterior;

axially-fixed and electric-conductive interface (114): one end thereof is connected to the connection side (104) of the heat dissipation member having axial and radial convection holes (101), the other end is a screw-in type, insertion type or lock-on type lamp head or lamp holder structure, or an electric conductive interface structure configured by an electric conductive terminal structure, provided as a connection interface for the LED (111) and an axial external electric power, and connected to the LED (111) with an electric conductive member for transmitting electric power.

Figure 11:
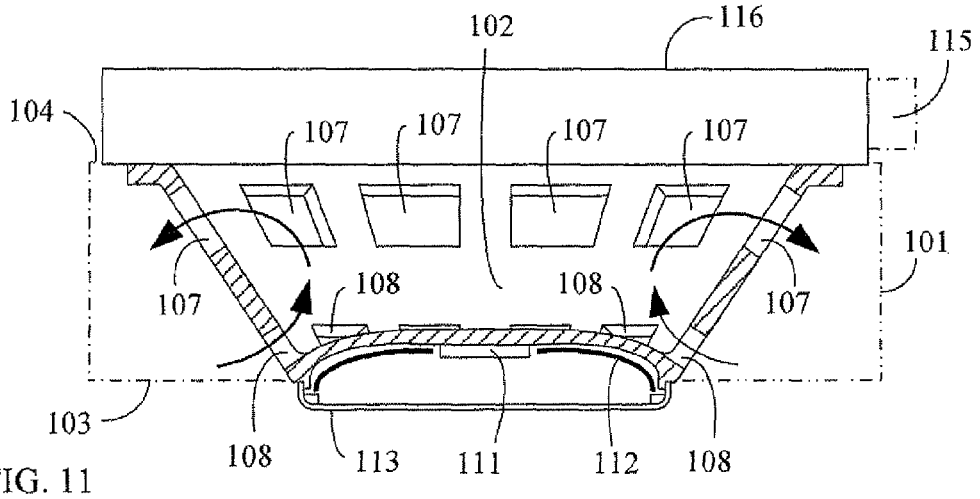
FIG. 11 is a schematic structural view illustrating the embodiment disclosed in FIG. 3 being applied in a heat dissipation member having axial and radial convection holes (101) having the top being installed with a radially-fixed and electric conductive interface (115) and installed with a top cover member (116), according to one embodiment of the present invention.
Figure 12:
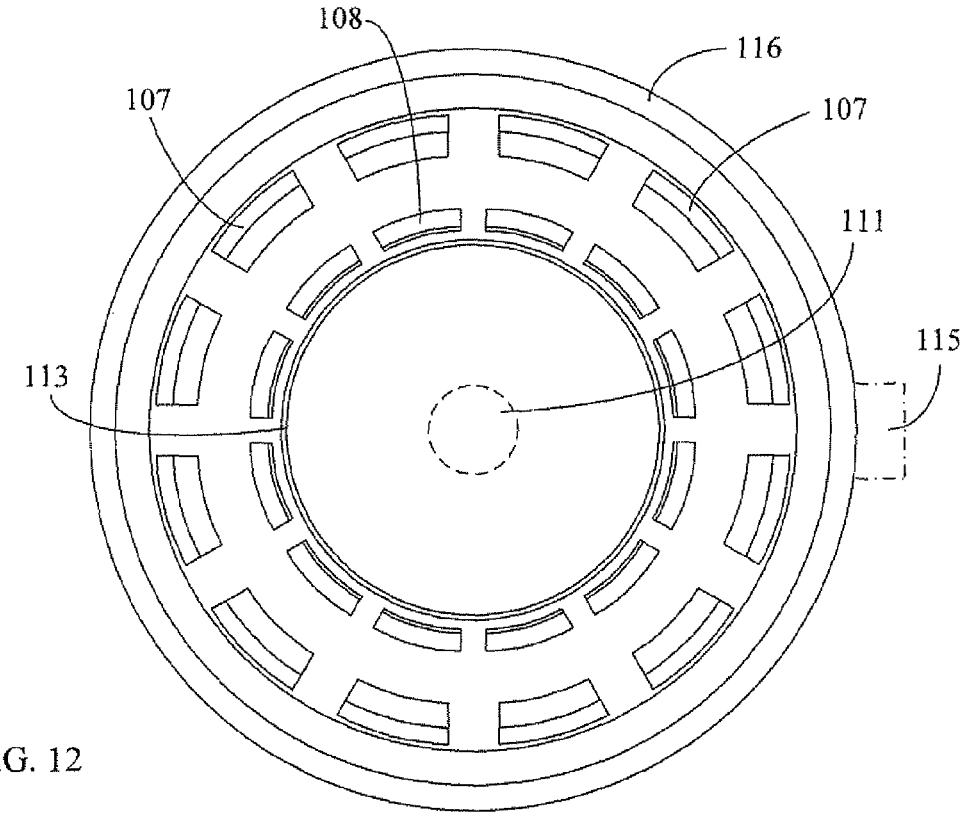
FIG. 12 is a bottom view of FIG. 11.

FIG. 11 is a schematic structural view illustrating the embodiment disclosed in FIG. 3 being applied in a heat dissipation member having axial and radial convection holes (101) having the top being installed with a radially-fixed and electric conductive interface (115) and installed with a top cover member (116), according to one embodiment of the present invention;

FIG. 12 is a bottom view of FIG. 11;

As shown in FIG. 11 and FIG. 12, it mainly consists of:

heat dissipation member having axial and radial convection holes (101): made of a material having good heat conductivity and formed as an integral or assembled hollow member, and said hollow member is a sealed or semi-sealed structure, the outer radial surface is formed as a smooth surface, rib surface, grid surface, porous, net-shaped or fin-shaped structure, thereby forming an external heat dissipation surface (105); the radial interior is formed as a smooth surface, rib surface, grid surface, porous, net-shaped or fin-shaped structure, thereby forming an internal heat dissipation surface (106); the center is formed with an axial tubular flowpath (102) serving as an axial hole allowing airflow to pass, and one axial side of the heat dissipation member having axial and radial convection holes (101) is defined as a light projection side (103) allowing a LED (111) to be installed thereon, and the other axial side is defined as a connection side (104) serving as the structure for external connection;

one end of the heat dissipation member having axial and radial convection holes (101) near the connection side (104) is installed with one or more than one radial air outlet holes (107), and said radial air outlet hole (107) includes grid holes configured by a hole-shaped or net-shaped structure;

With the mentioned structure when generating heat loss during the LED (111) being electrically conducted for emitting light, the air flowing formed through the hot airflow in the heat dissipation member having axial and radial convection holes (101) generating a hot ascent/cold descent effect for introducing airflow from one or more than one radial air inlet ports (108) of the light projection side (103) to pass the axial hole configured by the axial tubular flowpath (102) then be discharged from the radial air outlet hole (107) formed near the connection side (104) of the heat dissipation member having axial and radial convection holes (101), thereby discharging thermal energy in the axial tubular flowpath (102) to the exterior;

light emitting diode (LED) (111): constituted by one or more than one light emitting diodes or modules, and installed at the center of the light projection side (103) of the heat dissipation member having axial and radial convection holes (101);

radial air inlet port (108): constituted by one or more than one radial air inlet ports (108) installed near the outer periphery of the light projection side (103) of the heat dissipation member having axial and radial convection holes (101), and said radial air inlet port (108) includes grid holes configured by a hole-shaped or net-shaped structure;

secondary optical device (112): provided with functions of condensing, diffusing, refracting or reflecting the optical energy of the LED (111) for projecting light to the exterior;

light-pervious lampshade (113): made of a light-pervious material, covering the LED (111) for the purpose of protecting the LED (111), and allowing the optical energy of LED (111) passing through for projecting to the exterior;

radially-fixed and electric-conductive interface (115): one end thereof is connected to the connection side (104) of the heat dissipation member having axial and radial convection holes (101), the other end is a screw-in type, insertion type or lock-on type lamp head or lamp holder structure, or an electric conductive interface structure configured by an electric conductive terminal structure, provided as a connection interface for the LED (111) and a radial external electric power, and connected to the LED (111) with an electric conductive member for transmitting electric power;

top cover member (116): made of a thermal conductive or non thermal conductive material, connected at the connection side (104) of the heat dissipation member having axial and radial convection holes (101) for providing insulation and protection to the heat dissipation member having axial and radial convection holes (101), or providing functions of optical reflecting or refracting or condensing or diffusing; when being made of a thermal conductive material, the top cover member (116) further provides with a function of assisting the heat dissipation of the heat dissipation member having axial and radial convection holes (101).

Figure 13:
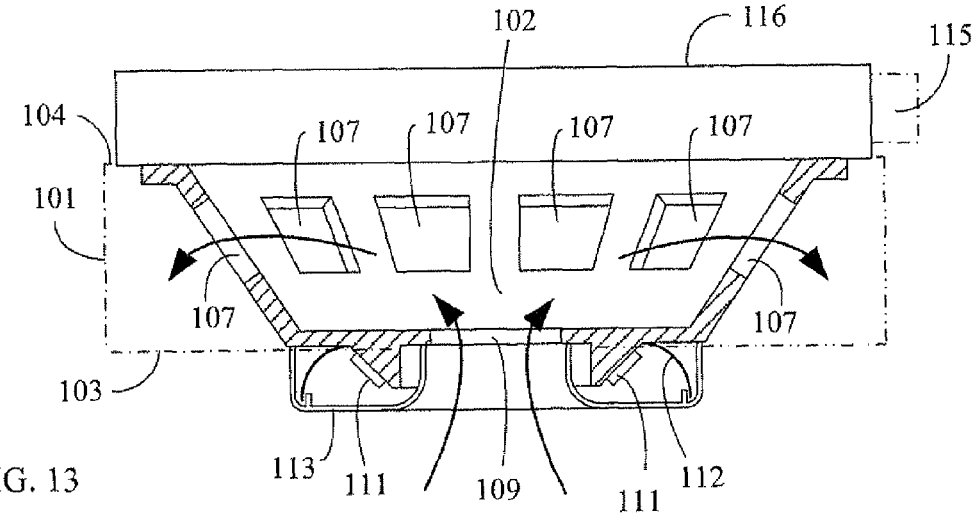
FIG. 13 is a schematic structural view illustrating the embodiment disclosed in FIG. 5 being applied in the heat dissipation member having axial and radial convection holes (101) having the top being installed with a radially-fixed and electric conductive interface (115) and installed with a top cover member (116), according to one embodiment of the present invention.
Figure 14:
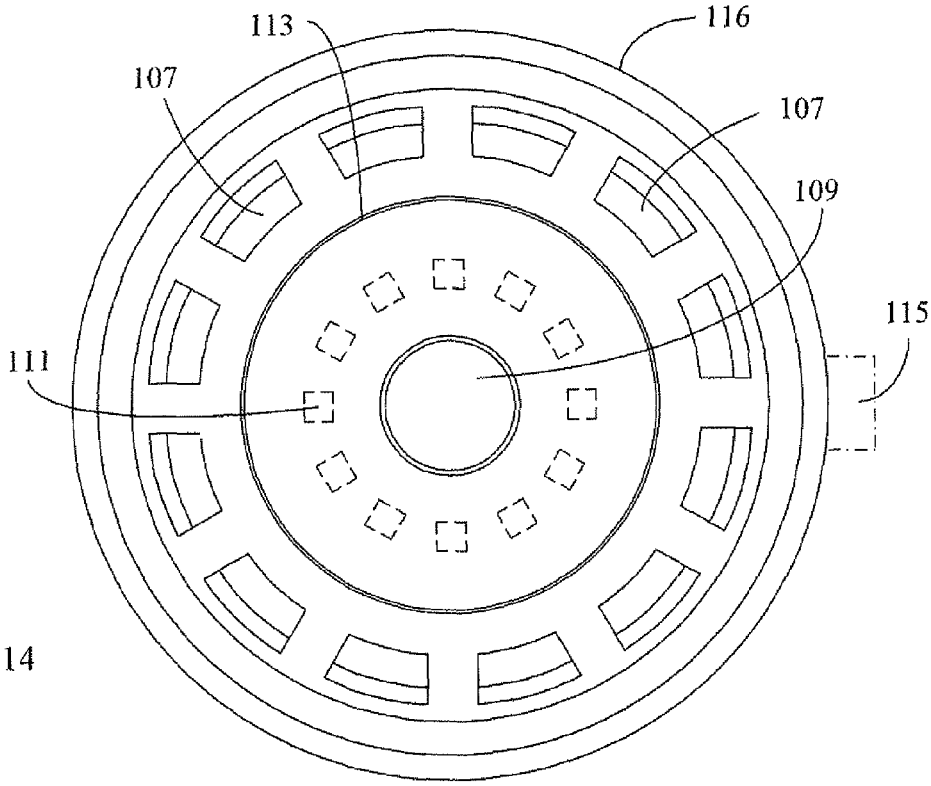
FIG. 14 is a bottom view of FIG. 13.

FIG. 13 is a schematic structural view illustrating the embodiment disclosed in FIG. 5 being applied in the heat dissipation member having axial and radial convection holes (101) having the top being installed with a radially-fixed and electric conductive interface (115) and installed with a top cover member (116), according to one embodiment of the present invention;

FIG. 14 is a bottom view of FIG. 13;

As shown in FIG. 13 and FIG. 14, it mainly consists of:

heat dissipation member having axial and radial convection holes (101): made of a material having good heat conductivity and formed as an integral or assembled hollow member, and said hollow member is a sealed or semi-sealed structure, the outer radial surface is formed as a smooth surface, rib surface, grid surface, porous, net-shaped or fin-shaped structure, thereby forming an external heat dissipation surface (105); the radial interior is formed as a smooth surface, rib surface, grid surface, porous, net-shaped or fin-shaped structure, thereby forming an internal heat dissipation surface (106); the center is formed with an axial tubular flowpath (102) serving as an axial hole allowing airflow to pass, and one axial side of the heat dissipation member having axial and radial convection holes (101) is defined as a light projection side (103) allowing a LED (111) to be installed thereon, and the other axial side is defined as a connection side (104) serving as the structure for external connection;

one end of the heat dissipation member having axial and radial convection holes (101) near the connection side (104) is installed with one or more than one radial air outlet holes (107), and said radial air outlet hole (107) includes grid holes configured by a hole-shaped or net-shaped structure;

With the mentioned structure when generating heat loss during the LED (111) being electrically conducted for emitting light, the air flowing formed through the hot airflow in the heat dissipation member having axial and radial convection holes (101) generating a hot ascent/cold descent effect for introducing airflow from the central axial air inlet port (109) of the light projection side (103) to pass the axial hole configured by the axial tubular flowpath (102) then be discharged from the radial air outlet hole (107) formed near the connection side (104) of the heat dissipation member having axial and radial convection holes (101), thereby discharging thermal energy in the axial tubular flowpath (102) to the exterior;

light emitting diode (LED) (111): constituted by one or more than one light emitting diodes or modules, and installed at the outer periphery of the light projection side (103) of the heat dissipation member having axial and radial convection holes (101);

central axial air inlet port (109): constituted by a central axial air inlet port structure installed on the axial end surface of the light projection side (103) of the heat dissipation member having axial and radial convection holes (101) for communicating to the axial tubular flowpath (102), and said central axial air inlet port (109) includes grid holes configured by a hole-shaped or net-shaped structure;

secondary optical device (112): provided with functions of condensing, diffusing, refracting or reflecting the optical energy of the LED (111) for projecting light to the exterior;

light-pervious lampshade (113): made of a light-pervious material, covering the LED (111) for the purpose of protecting the LED (111), and allowing the optical energy of LED (111) passing through for projecting to the exterior;

radially-fixed and electric-conductive interface (115): one end thereof is connected to the connection side (104) of the heat dissipation member having axial and radial convection holes (101), the other end is a screw-in type, insertion type or lock-on type lamp head or lamp holder structure, or an electric conductive interface structure configured by an electric conductive terminal structure, provided as a connection interface for the LED (111) and a radial external electric power, and connected to the LED (111) with an electric conductive member for transmitting electric power;

top cover member (116): made of a thermal conductive or non thermal conductive material, connected at the connection side (104) of the heat dissipation member having axial and radial convection holes (101) for providing insulation and protection to the heat dissipation member having axial and radial convection holes (101), or providing functions of optical reflecting or refracting or condensing or diffusing; when being made of a thermal conductive material, the top cover member (116) further provides with a function of assisting the heat dissipation of the heat dissipation member having axial and radial convection holes (101).

Figure 15:
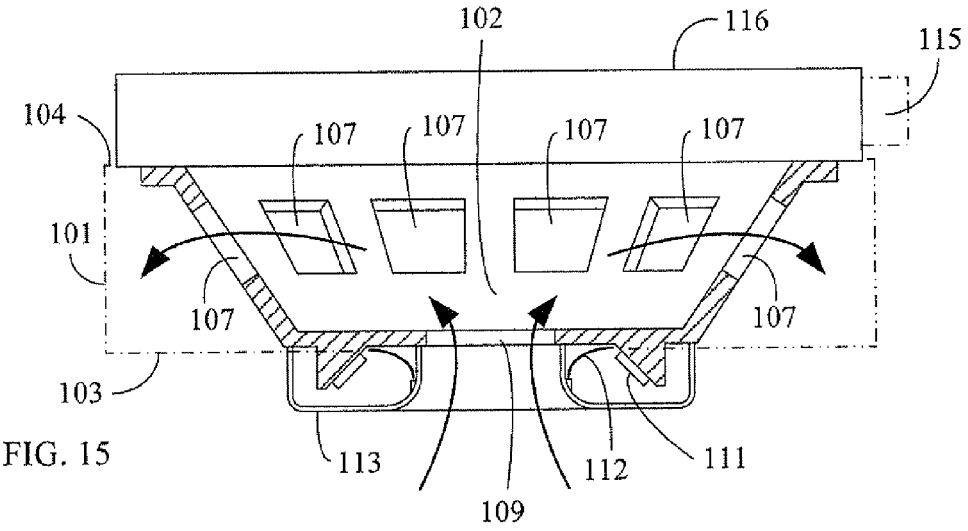
FIG. 15 is a schematic structural view illustrating the embodiment disclosed in FIG. 7 being applied in the heat dissipation member having axial and radial convection holes (101) having the top being installed with a radially-fixed and electric conductive interface (115) and installed with a top cover member (116), according to one embodiment of the present invention.
Figure 16:
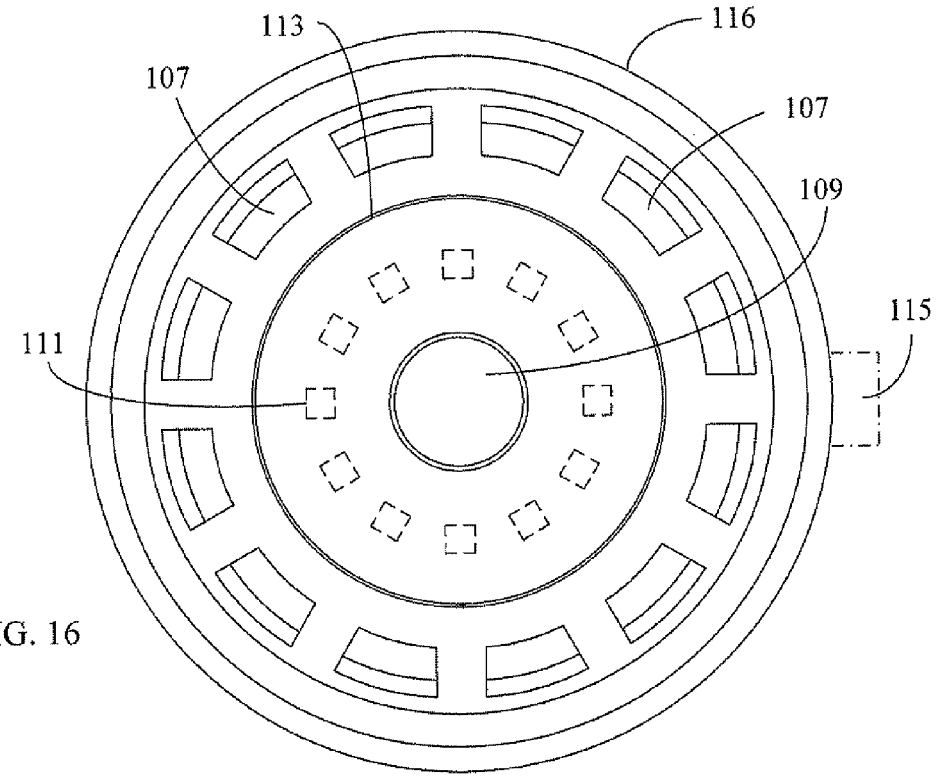
FIG. 16 is a bottom view of FIG. 15.

FIG. 15 is a schematic structural view illustrating the embodiment disclosed in FIG. 7 being applied in the heat dissipation member having axial and radial convection holes (101) having the top being installed with a radially-fixed and electric conductive interface (115) and installed with a top cover member (116), according to one embodiment of the present invention;

FIG. 16 is a bottom view of FIG. 15;

As shown in FIG. 15 and FIG. 16, it mainly consists of:

heat dissipation member having axial and radial convection holes (101): made of a material having good heat conductivity and formed as an integral or assembled hollow member, and said hollow member is a sealed or semi-sealed structure, the outer radial surface is formed as a smooth surface, rib surface, grid surface, porous, net-shaped or fin-shaped structure, thereby forming an external heat dissipation surface (105); the radial interior is formed as a smooth surface, rib surface, grid surface, porous, net-shaped or fin-shaped structure, thereby forming an internal heat dissipation surface (106); the center is formed with an axial tubular flowpath (102) serving as an axial hole allowing airflow to pass, and one axial side of the heat dissipation member having axial and radial convection holes (101) is defined as a light projection side (103) allowing a LED (111) to be installed thereon, and the other axial side is defined as a connection side (104) serving as the structure for external connection;

one end of the heat dissipation member having axial and radial convection holes (101) near the connection side (104) is installed with one or more than one radial air outlet holes (107), and said radial air outlet hole (107) includes grid holes configured by a hole-shaped or net-shaped structure;

With the mentioned structure when generating heat loss during the LED (111) being electrically conducted for emitting light, the air flowing formed through the hot airflow in the heat dissipation member having axial and radial convection holes (101) generating a hot ascent/cold descent effect for introducing airflow from the central axial air inlet port (109) of the light projection side (103) to pass the axial hole configured by the axial tubular flowpath (102) then be discharged from the radial air outlet hole (107) formed near the connection side (104) of the heat dissipation member having axial and radial convection holes (101), thereby discharging thermal energy in the axial tubular flowpath (102) to the exterior;

light emitting diode (LED) (111): constituted by one or more than one light emitting diodes or modules, and installed at the inner periphery of the light projection side (103) of the heat dissipation member having axial and radial convection holes (101);

central axial air inlet port (109): constituted by a central axial air inlet port structure installed on the axial end surface of the light projection side (103) of the heat dissipation member having axial and radial convection holes (101) for communicating to the axial tubular flowpath (102), and said central axial air inlet port (109) includes grid holes configured by a hole-shaped or net-shaped structure;

secondary optical device (112): provided with functions of condensing, diffusing, refracting or reflecting the optical energy of the LED (111) for projecting light to the exterior;

light-pervious lampshade (113): made of a light-pervious material, covering the LED (111) for the purpose of protecting the LED (111), and allowing the optical energy of LED (111) passing through for projecting to the exterior;

radially-fixed and electric-conductive interface (115): one end thereof is connected to the connection side (104) of the heat dissipation member having axial and radial convection holes (101), the other end is a screw-in type, insertion type or lock-on type lamp head or lamp holder structure, or an electric conductive interface structure configured by an electric conductive terminal structure, provided as a connection interface for the LED (111) and a radial external electric power, and connected to the LED (111) with an electric conductive member for transmitting electric power;

top cover member (116): made of a thermal conductive or non thermal conductive material, connected at the connection side (104) of the heat dissipation member having axial and radial convection holes (101) for providing insulation and protection to the heat dissipation member having axial and radial convection holes (101), or providing functions of optical reflecting or refracting or condensing or diffusing; when being made of a thermal conductive material, the top cover member (116) further provides with a function of assisting the heat dissipation of the heat dissipation member having axial and radial convection holes (101).

Figure 17:
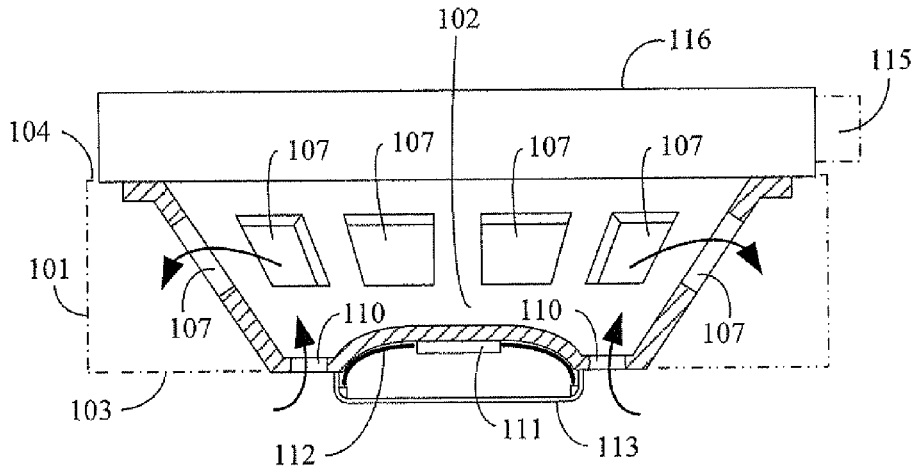
FIG. 17 is a schematic structural view illustrating the embodiment disclosed in FIG. 9 being applied in the heat dissipation member having axial and radial convection holes (101) having the top being installed with a radially-fixed and electric conductive interface (115) and installed with a top cover member (116), according to one embodiment of the present invention.
Figure 18:
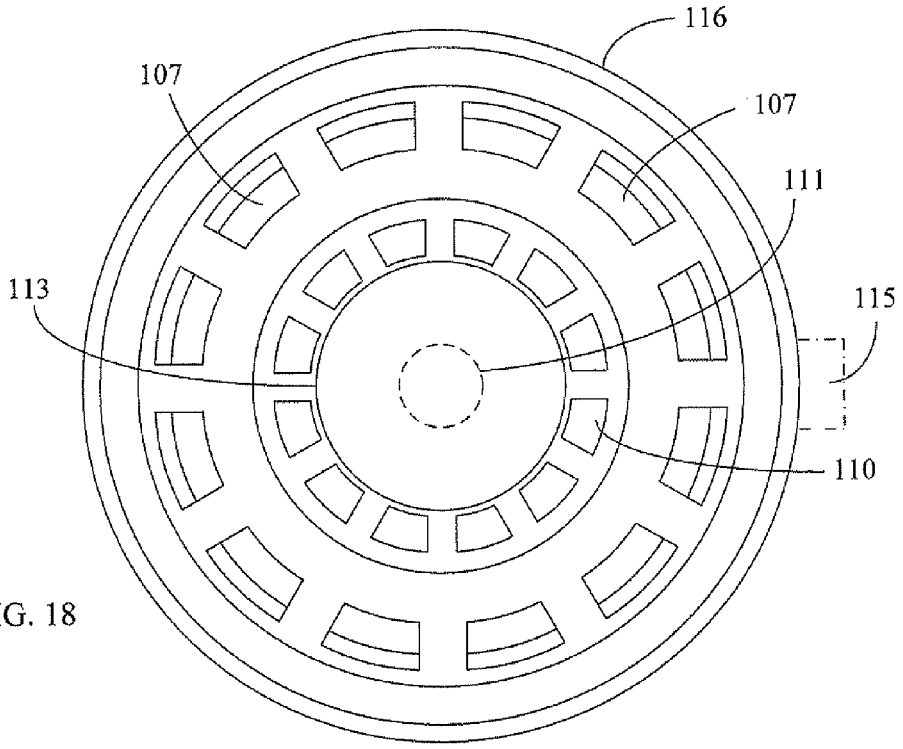
FIG. 18 is a bottom view of FIG. 17.

FIG. 17 is a schematic structural view illustrating the embodiment disclosed in FIG. 9 being applied in the heat dissipation member having axial and radial convection holes (101) having the top being installed with a radially-fixed and electric conductive interface (115) and installed with a top cover member (116), according to one embodiment of the present invention;

FIG. 18 is a bottom view of FIG. 17;

As shown in FIG. 17 and FIG. 18, it mainly consists of heat dissipation member having axial and radial convection holes (101): made of a material having good heat conductivity and formed as an integral or assembled hollow member, and said hollow member is a sealed or semi-sealed structure, the outer radial surface is formed as a smooth surface, rib surface, grid surface, porous, net-shaped or fin-shaped structure, thereby forming an external heat dissipation surface (105); the radial interior is formed as a smooth surface, rib surface, grid surface, porous, net-shaped or fin-shaped structure, thereby forming an internal heat dissipation surface (106); the center is formed with an axial tubular flowpath (102) serving as an axial hole allowing airflow to pass, and one axial side of the heat dissipation member having axial and radial convection holes (101) is defined as a light projection side (103) allowing a LED (111) to be installed thereon, and the other axial side is defined as a connection side (104) serving as the structure for external connection;

one end of the heat dissipation member having axial and radial convection holes (101) near the connection side (104) is installed with one or more than one radial air outlet holes (107), and said radial air outlet hole (107) includes grid holes configured by a hole-shaped or net-shaped structure;

With the mentioned structure when generating heat loss during the LED (111) being electrically conducted for emitting light, the air flowing formed through the hot airflow in the heat dissipation member having axial and radial convection holes (101) generating a hot ascent/cold descent effect for introducing airflow from one or more than one air inlet ports annularly arranged near the periphery of axial end surface (110) at the light projection side (103) to pass the axial hole configured by the axial tubular flowpath (102) then be discharged from the radial air outlet hole (107) formed near the connection side (104) of the heat dissipation member having axial and radial convection holes (101), thereby discharging thermal energy in the axial tubular flowpath (102) to the exterior;

light emitting diode (LED) (111): constituted by one or more than one light emitting diodes or modules, and installed at the center of the light projection side (103) of the heat dissipation member having axial and radial convection holes (101);

air inlet port annularly arranged near the periphery of axial end surface (110): constituted by one or more than one air inlet port structures annularly installed near the periphery of axial end surface of the light projection side (103) of the heat dissipation member having axial and radial convection holes (101) for communicating to the axial tubular flowpath (102), and said air inlet port annularly arranged near the periphery of axial end surface (110) includes grid holes configured by a hole-shaped or net-shaped structure;

secondary optical device (112): provided with functions of condensing, diffusing, refracting or reflecting the optical energy of the LED (111) for projecting light to the exterior;

light-pervious lampshade (113): made of a light-pervious material, covering the LED (111) for the purpose of protecting the LED (111), and allowing the optical energy of LED (111) passing through for projecting to the exterior;

radially-fixed and electric-conductive interface (115): one end thereof is connected to the connection side (104) of the heat dissipation member having axial and radial convection holes (101), the other end is a screw-in type, insertion type or lock-on type lamp head or lamp holder structure, or an electric conductive interface structure configured by an electric conductive terminal structure, provided as a connection interface for the LED (111) and a radial external electric power, and connected to the LED (111) with an electric conductive member for transmitting electric power;

top cover member (116): made of a thermal conductive or non thermal conductive material, connected at the connection side (104) of the heat dissipation member having axial and radial convection holes (101) for providing insulation and protection to the heat dissipation member having axial and radial convection holes (101), or providing functions of optical reflecting or refracting or condensing or diffusing; when being made of a thermal conductive material, the top cover member (116) further provides with a function of assisting the heat dissipation of the heat dissipation member having axial and radial convection holes (101).

Figure 19:
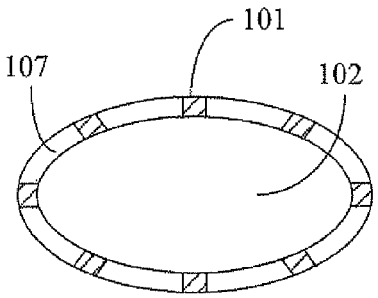
FIG. 19 is a schematic view illustrating the axial A-A cross section of the axial tubular flowpath (102) shown in FIG. 1 being formed as an oval hole, according to one embodiment of the present invention.

According to the present invention, when the LED heat dissipation device having axial and radial convection holes being further applied, air inlet ports can be installed at plural locations, wherein:

one end of the heat dissipation member having axial and radial convection holes (101) near the connection side (104) is installed with one or more than one radial air outlet holes (107), and the light projection side (103) is installed with air inlet ports, said air inlet ports are installed to at least one or more than one of three locations which include the outer periphery being installed with a radial air inlet port (108) and/or the center of axial end surface of the light projection side (103) being installed with a central axial air inlet port (109) and/or the light projection side (103) being installed with an air inlet port annularly arranged near the periphery of axial end surface (110);

According to the LED heat dissipation device having axial and radial convection holes, the shape of the axial tubular flowpath (102) is not limited to be formed in the round shape, which can be further included with an oval tubular flowpath, triangle tubular flowpath, rectangular tubular flowpath, pentagonal tubular flowpath, hexangular tubular flowpath, polygonal tubular flowpath having more than six angles, U-shaped tubular flowpath, singular-slot hole tubular flowpath with dual open ends, or multiple-slot hole tubular flowpath with dual open ends; or can be shaped to a cross section having plural angles or geometric shapes, etc., illustrated with the following embodiment:

FIG. 19 is a schematic view illustrating the axial A-A cross section of the axial tubular flowpath (102) shown in FIG. 1 being formed as an oval hole, according to one embodiment of the present invention.

As shown in FIG. 19, the main configuration is that the heat dissipation member having axial and radial convection holes (101) is made of a material having good thermal conductivity, and between the radial air outlet hole near the connection side (104) and the air inlet port near the light projection side (103), the axial tubular flowpath (102) is served as a communicated tubular flowpath, wherein the A-A cross section of the tubular flowpath is in an oval shape.

Figure 20:
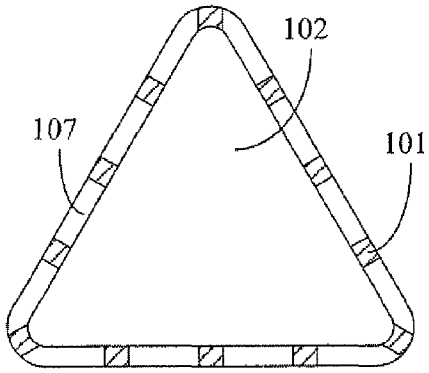
FIG. 20 is a schematic view illustrating the axial A-A cross section of the axial tubular flowpath (102) shown in FIG. 1 being formed as a triangular hole, according to one embodiment of the present invention.

FIG. 20 is a schematic view illustrating the axial A-A cross section of the axial tubular flowpath (102) shown in FIG. 1 being formed as a triangular hole, according to one embodiment of the present invention;

As shown in FIG. 20, the main configuration is that the heat dissipation member having axial and radial convection holes (101) is made of a material having good thermal conductivity, and between the radial air outlet hole near the connection side (104) and the air inlet port near the light projection side (103), the axial tubular flowpath (102) is served as a communicated tubular flowpath, wherein the A-A cross section of the tubular flowpath is in a triangular or triangular-like shape.

Figure 21:
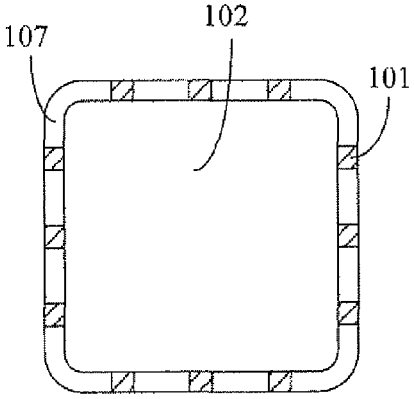
FIG. 21 is a schematic view illustrating the axial A-A cross section of the axial tubular flowpath (102) shown in FIG. 1 being formed as a rectangular hole, according to one embodiment of the present invention.

FIG. 21 is a schematic view illustrating the axial A-A cross section of the axial tubular flowpath (102) shown in FIG. 1 being formed as a rectangular hole, according to one embodiment of the present invention;

As shown in FIG. 21, the main configuration is that the heat dissipation member having axial and radial convection holes (101) is made of a material having good thermal conductivity, and between the radial air outlet hole near the connection side (104) and the air inlet port near the light projection side (103), the axial tubular flowpath (102) is served as a communicated tubular flowpath, wherein the A-A cross section of the tubular flowpath is in a rectangular or rectangular-like shape.

Figure 22:
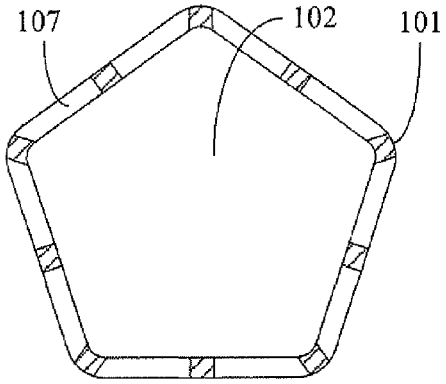
FIG. 22 is a schematic view illustrating the axial A-A cross section of the axial tubular flowpath (102) shown in FIG. 1 being formed as a pentagonal hole, according to one embodiment of the present invention.

FIG. 22 is a schematic view illustrating the axial A-A cross section of the axial tubular flowpath (102) shown in FIG. 1 being formed as a pentagonal hole, according to one embodiment of the present invention;

As shown in FIG. 22, the main configuration is that the heat dissipation member having axial and radial convection holes (101) is made of a material having good thermal conductivity, and between the radial air outlet hole near the connection side (104) and the air inlet port near the light projection side (103), the axial tubular flowpath (102) is served as a communicated tubular flowpath, wherein the A-A cross section of the tubular flowpath is in a pentagonal or pentagonal-like shape.

Figure 23:
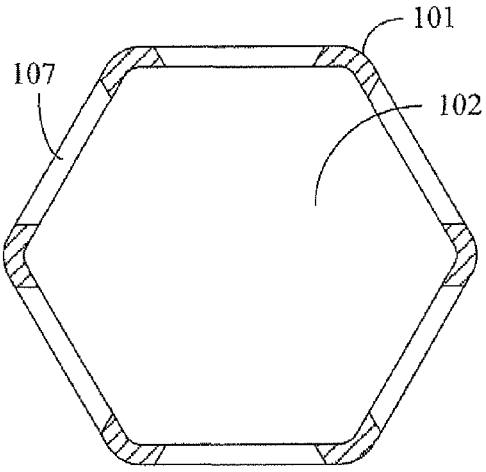
FIG. 23 is a schematic view illustrating the axial A-A cross section of the axial tubular flowpath (102) shown in FIG. 1 being formed as a hexagonal hole, according to one embodiment of the present invention.

FIG. 23 is a schematic view illustrating the axial A-A cross section of the axial tubular flowpath (102) shown in FIG. 1 being formed as a hexagonal hole, according to one embodiment of the present invention;

As shown in FIG. 23, the main configuration is that the heat dissipation member having axial and radial convection holes (101) is made of a material having good thermal conductivity, and between the radial air outlet hole near the connection side (104) and the air inlet port near the light projection side (103), the axial tubular flowpath (102) is served as a communicated tubular flowpath, wherein the A-A cross section of the tubular flowpath is in a hexagonal or hexagonal-like shape.

Figure 24:
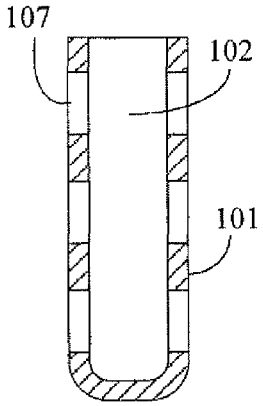
FIG. 24 is a schematic view illustrating the axial A-A cross section of the axial tubular flowpath (102) shown in FIG. 1 being formed as a U-shaped hole, according to one embodiment of the present invention.

FIG. 24 is a schematic view illustrating the axial A-A cross section of the axial tubular flowpath (102) shown in FIG. 1 being formed as a U-shaped hole, according to one embodiment of the present invention;

As shown in FIG. 24, the main configuration is that the heat dissipation member having axial and radial convection holes (101) is made of a material having good thermal conductivity, and between the radial air outlet hole near the connection side (104) and the air inlet port near the light projection side (103), the axial tubular flowpath (102) is served as a communicated tubular flowpath, wherein the A-A cross section of the tubular flowpath is in a U shape with single sealed side.

Figure 25:
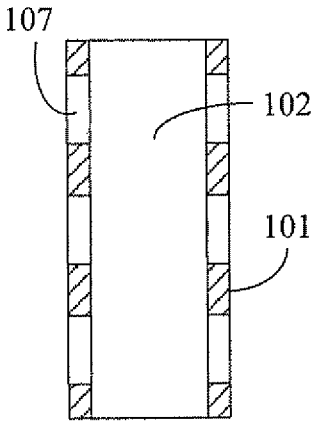
FIG. 25 is a schematic view illustrating the axial A-A cross section of the axial tubular flowpath (102) shown in FIG. 1 being formed as a singular-slot hole with dual open ends, according to one embodiment of the present invention.

FIG. 25 is a schematic view illustrating the axial A-A cross section of the axial tubular flowpath (102) shown in FIG. 1 being formed as a singular-slot hole with dual open ends, according to one embodiment of the present invention;

As shown in FIG. 25, the main configuration is that the heat dissipation member having axial and radial convection holes (101) is made of a material having good thermal conductivity, and between the radial air outlet hole near the connection side (104) and the air inlet port near the light projection side (103), the axial tubular flowpath (102) is served as a communicated tubular flowpath, wherein the A-A cross section of the tubular flowpath is formed as a singular-slot hole with dual open ends.

Figure 26:
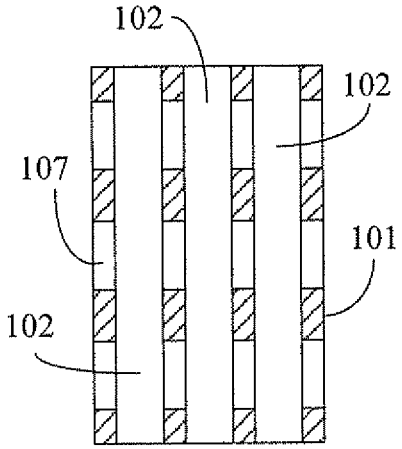
FIG. 26 is a schematic view illustrating the axial A-A cross section of the axial tubular flowpath (102) shown in FIG. 1 being formed as a multiple-slot hole with dual open ends, according to one embodiment of the present invention.

FIG. 26 is a schematic view illustrating the axial A-A cross section of the axial tubular flowpath (102) shown in FIG. 1 being formed as a multiple-slot hole with dual open ends, according to one embodiment of the present invention;

As shown in FIG. 26, the main configuration is that the heat dissipation member having axial and radial convection holes (101) is made of a material having good thermal conductivity, and between the radial air outlet hole near the connection side (104) and the air inlet port near the light projection side (103), the axial tubular flowpath (102) is served as a communicated tubular flowpath, wherein the A-A cross section of the tubular flowpath is in formed as two or more than two slot hole with dual open ends.

Figure 27:
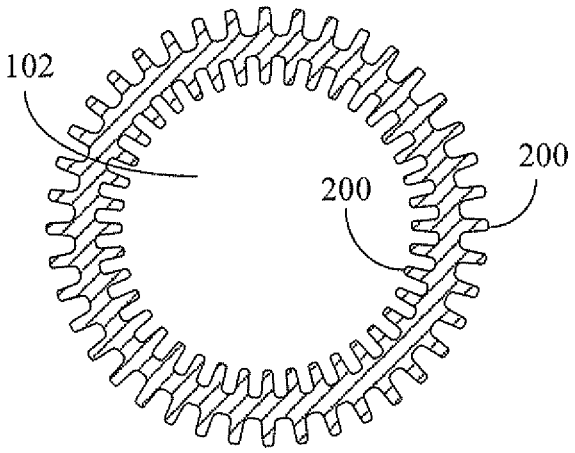
FIG. 27 is a schematic view illustrating the axial B-B cross section of the axial tubular flowpath (102) shown in FIG. 1 being formed as a heat dissipation fin structure (200), according to one embodiment of the present invention.

According to the LED heat dissipation device having axial and radial convection holes, both or at least one of the interior and the exterior of the axial cross section of the axial tubular flowpath (102) can be provided with a heat dissipation fin structure (200) for increasing the heat dissipation effect;

FIG. 27 is a schematic view illustrating the axial B-B cross section of the axial tubular flowpath (102) shown in FIG. 1 being formed as a heat dissipation fin structure (200), according to one embodiment of the present invention;

As shown in FIG. 27, the main configuration is that the heat dissipation member having axial and radial convection holes (101) is made of a material having good thermal conductivity, and between the radial air outlet hole near the connection side (104) and the air inlet port near the light projection side (103), the axial tubular flowpath (102) is served as a communicated tubular flowpath, wherein the B-B cross section of the tubular flowpath is formed with the heat dissipation fin structure (200).

Figure 28:
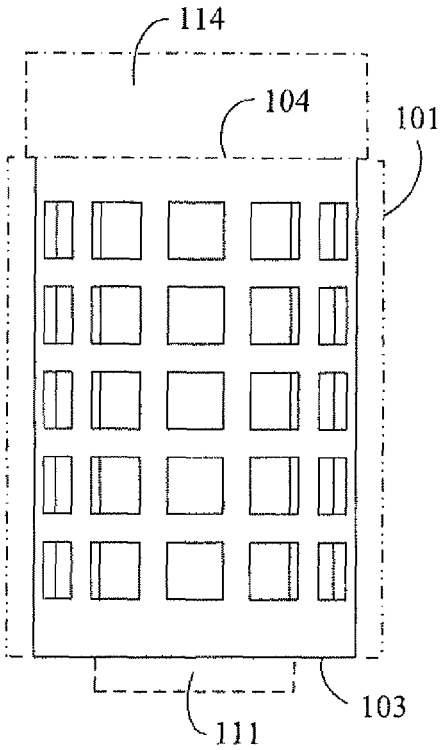
FIG. 28 is a schematic view showing the heat dissipation member having axial and radial convection holes (101) being formed as a porous structure, according to one embodiment of the present invention.
Figure 29:
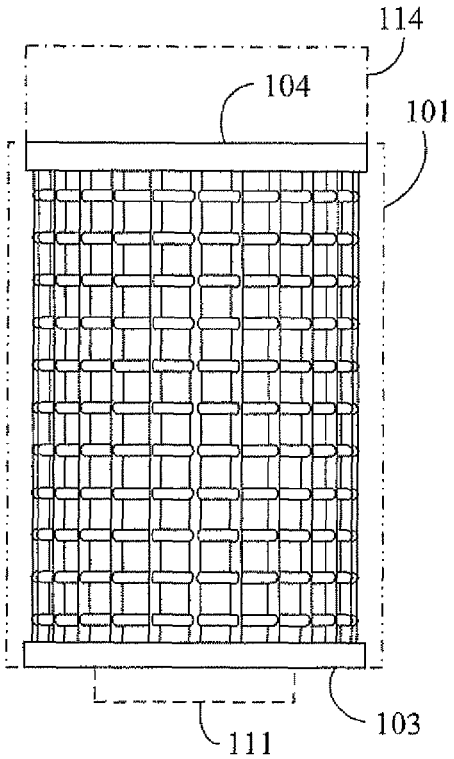
FIG. 29 is a schematic view showing the heat dissipation member having axial and radial convection holes (101) being formed as a net-shaped structure, according to one embodiment of the present invention.

According to the LED heat dissipation device having axial and radial convection holes, the heat dissipation member having axial and radial convection holes (101) can be further formed as a porous or net-shaped structure which is made of a thermal conductive material, and the holes of the porous structure and the net holes of the net-shaped structure can be used for replacing the radial air outlet hole (107) and the radial air inlet port (108); and the light projection side (103) is formed with a block-shaped heat conductive structure allowing the LED (111) to be installed thereon;

FIG. 28 is a schematic view showing the heat dissipation member having axial and radial convection holes (101) being formed as a porous structure, according to one embodiment of the present invention;

As shown in FIG. 28, in the LED heat dissipation device having axial and radial convection holes, the heat dissipation member having axial and radial convection holes (101) can be further formed as a porous structure made of a thermal conductive material, and the holes of the porous structure can be used for replacing the radial air outlet hole (107) and the radial air inlet port (108); and the light projection side (103) is formed with a block-shaped heat conductive structure allowing the LED (111) to be installed thereon;

FIG. 29 is a schematic view showing the heat dissipation member having axial and radial convection holes (101) being formed as a net-shaped structure, according to one embodiment of the present invention;

As shown in FIG. 29, in the LED heat dissipation device having axial and radial convection holes, the heat dissipation member having axial and radial convection holes (101) can be further formed as a net-shaped structure made of a thermal conductive material, and the net holes of the net-shaped structure can be used for replacing the radial air outlet hole (107) and the radial air inlet port (108); and the light projection side (103) is formed with a block-shaped heat conductive structure allowing the LED (111) to be installed thereon.

Figure 30:
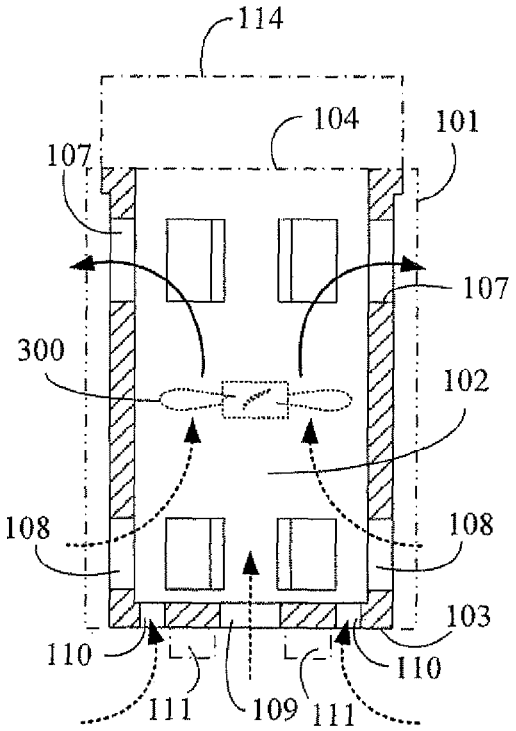
FIG. 30 is a schematic view illustrating an electric motor driven fan (300) being provided in the interior, according to one embodiment of the present invention.

According to the LED heat dissipation device having axial and radial convection holes, the interior of the axial tubular flowpath (102) can be installed with an electric motor driven fan (300) for assisting the flowing of the hot airflow in the axial tubular flowpath (102) for increasing the heat dissipation effect;

FIG. 30 is a schematic view illustrating an electric motor driven fan (300) being provided in the interior, according to one embodiment of the present invention;

As shown in FIG. 30, in the LED heat dissipation device having axial and radial convection holes, the airflow in the axial tubular flowpath (102) not only can be driven by the hot ascent/cool descent effect, the electric motor driven fan (300) can be further installed in the axial tubular flowpath (102) for assisting the flowing of the hot airflow in the axial tubular flowpath (102), and thereby increasing the heat dissipation effect.

The invention claimed is:

1. An LED heat dissipation device, comprising:

a heat dissipation member (101) having axial and radial convection holes (101), wherein:

said heat dissipation member is thermally conductive, hollow, at least partially sealed, and has first axial end and a second axial end, said heat dissipation member (101) includes an external heat dissipation surface (105) and an internal heat dissipation surface (106), both extending between said first and second ends, and an axial flowpath (102) that extends centrally through the heat dissipation member, said first end is a light projection side (103) having an axial end surface on which at least one LED (111) is installed, said second end is a connection side (104), at least one of said convection holes that is adjacent said connection end (104) is a radial air outlet port (107), the light projection side (103) includes a plurality of said convection holes (101) that serve as air inlet ports (108 and/or 109), said air inlet ports including a plurality of radial air inlet ports (108), an axial central air inlet port (109) at a center of the axial end surface, and a plurality of additional axial air inlet ports (110) annularly arranged around a periphery of the axial end surface, heat generated by the at least one LED (111) causes airflow resulting from convection, said airflow entering the heat dissipation member through the air inlet port (108 and/or 109) before passing through the axial flow path (102) and exiting the heat dissipation member through the radial air outlet hole (107), and thermal energy carried by said airflow is discharged to an exterior of the heat dissipation device at least in part by transfer from the airflow to said internal heat dissipation surface (106) and from the internal heat dissipation surface (106) to the external heat dissipation surface (105).

2. A heat dissipation device as claimed in claim 1, further comprising:

a secondary optical device (112) arranged to have at least one functions of condensing, diffusing, refracting, and reflecting optical energy emitted by the LED (111);

a light pervious protective lampshade (113) covering the LED (111); and an axially-fixed and electrically-conductive interface (114) electrically connected to the at least one LED (111) and situated on the connection side (104) of the heat dissipation member, said interface (114) including one of an electrically conductive terminal structure, a screw-in connector structure, an insertion-type connector structure, a lock-on connector structure, and a lamp-holder structure for supplying electrical power from an external power source to the at least one LED (111).

3. A heat dissipation device as claimed in claim 2, wherein the at least one LED (111) includes a plurality of LEDs installed between said axial central air inlet port (109) and said annularly arranged additional axial air inlet ports.

4. A heat dissipation device as claimed in claim 2, wherein said axial central air inlet port (109) forms an inner periphery of the light projection side (103), and the at least one LED (111) includes LEDs installed near said inner periphery of the light projection side (103).

5. A heat dissipation device as claimed in claim 1, further comprising an electrically-conductive interface (115) electrically connected to the at least one LED (111) and situated on the connection side (104) of the heat dissipation member, said interface (115) including one of an electrically conductive terminal structure, a screw-in connector structure, an insertion-type connector structure, a lock-on connector structure, and a lamp-holder structure for supplying electrical power from an external power source to the at least one LED (111), wherein said electrically-conductive interface (115) is radially fixed to a top cover member (116).

6. A heat dissipation device as claimed in claim 5, wherein the top cover member (116) is a thermally-insulating member that protects and thermally insulates the heat dissipation member.

7. A heat dissipation device as claimed in claim 5, wherein the top cover member (116) is a thermally-conductive member that assists in heat dissipation by the heat dissipation member.

8. A heat dissipation device as claimed in claim 5, wherein the top cover member (116) is arranged to have at least one functions of condensing, diffusing, refracting, and reflecting optical energy emitted by the LED (111).

9. A heat dissipation device as claimed in claim 1, wherein said axial flowpath (102) has a cross-section transverse to an axial direction of the heat dissipation member, said cross-section having one of a round, oval, triangular, rectangular, pentagonal, hexangular, polygonal, and U shape.

10. A heat dissipation device as claimed in claim 1, wherein at least one of the external heat dissipation surface (105) and an internal heat dissipation surface (106) includes a fin structure (200) extending therefrom to enhance heat dissipation.

11. A heat dissipation device as claimed in claim 1, wherein said convection holes are formed by a porous or net-shaped structure of said heat dissipation member, said light projection side (103) including a block-shaped heat conductive structure on which the LED (111) is installed.

12. A heat dissipation device as claimed in claim 1, further comprising an electric motor driven fan (300) installed in said axial flowpath (102) for enhancing heat dissipation.

* * * * *